US006091343A

United States Patent [19]

Dykema et al.

[11] Patent Number: 6,091,343

[45] Date of Patent: Jul. 18, 2000

[54] TRAINABLE RF TRANSMITTER HAVING EXPANDED LEARNING CAPABILITIES

[75] Inventors: Kurt A. Dykema, Holland, Mich.; Mark D. Matlin, Boulder; Kenneth R. Zurawski, Louisville, both of Colo.

[73] Assignee: Prince Corporation, Holland, Mich.

[21] Appl. No.: 08/993,420

[22] Filed: Dec. 18, 1997

[51] Int. Cl.[7] ..... G08C 19/00

[52] U.S. Cl. ..... 340/825.69; 340/825.72

[58] Field of Search ..... 340/825.22, 825.2, 340/825.69, 825.72, 825.31, 825.34, 525; 364/188; 375/347, 202; 382/100; 343/700, 790; 455/101

[56] References Cited

U.S. PATENT DOCUMENTS

| | | | |
|---|---|---|---|
| 5,379,453 | 1/1995 | Tigwell . | |
| 5,442,340 | 8/1995 | Dykema . | |
| 5,479,155 | 12/1995 | Zeinstra et al. . | |
| 5,564,101 | 10/1996 | Eisfield et al. . | |
| 5,583,485 | 12/1996 | Van Lente et al. . | |
| 5,614,885 | 3/1997 | Van Lente et al. . | |
| 5,614,891 | 3/1997 | Zeinstra et al. . | |
| 5,619,190 | 4/1997 | Duckworth et al. . | |
| 5,627,529 | 5/1997 | Duckworth et al. . | |
| 5,646,701 | 7/1997 | Duckworth et al. . | |
| 5,661,651 | 8/1997 | Geschke et al. . | |
| 5,661,804 | 8/1997 | Dykema et al. . | |
| 5,680,263 | 10/1997 | Zimmermann et al. . | |
| 5,686,903 | 11/1997 | Duckworth et al. . | |
| 5,699,054 | 12/1997 | Duckworth . | |
| 5,699,055 | 12/1997 | Dykema et al. . | |
| 5,715,525 | 2/1998 | Tarusawa et al. | 455/101 |
| 5,793,300 | 8/1998 | Suman et al. | 340/825.2 |
| 5,809,405 | 9/1998 | Yamaura | 455/101 |
| 5,812,097 | 9/1998 | Maldonado | 343/790 |

FOREIGN PATENT DOCUMENTS

| | | |
|---|---|---|
| 1261150 | 12/1993 | Italy . |
| 9402920 | 2/1994 | WIPO . |

*Primary Examiner*—Howard L. Williams
*Assistant Examiner*—Jean B. Jeanglaude
*Attorney, Agent, or Firm*—Harness, Dickey & Pierce, P.L.C.

[57] ABSTRACT

A trainable transmitter is described that is capable of learning and replicating both AM and FM signals. The trainable transmitter also has the capacity to learn and replicate RF signals in both the 27 MHz to 40 MHz and the 250 MHz to 450 MHz frequency bands commonly used in European garage door openers. The trainable transmitter allows an individual to input an identification of the country in which the trainable transmitter will be operated such that the trainable transmitter may then transmit the learned signals at the maximum levels permitted for the identified county.

25 Claims, 8 Drawing Sheets

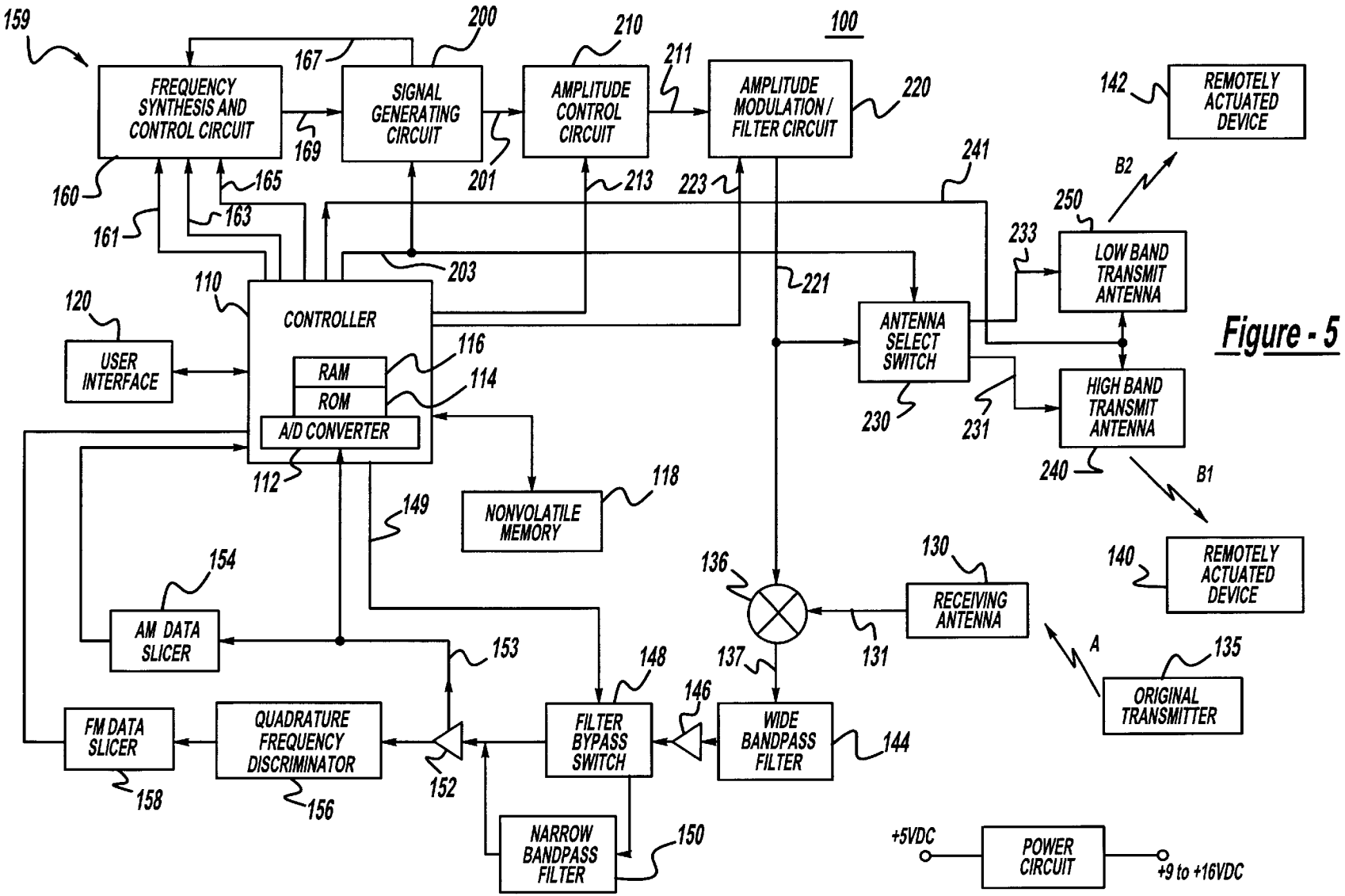
Figure - 5
100
REMOTELY ACTUATED DEVICE
142
B2
LOW BAND TRANSMIT ANTENNA
250
HIGH BAND TRANSMIT ANTENNA
240
B1
REMOTELY ACTUATED DEVICE
140
ORIGINAL TRANSMITTER
135
A
+9 to +16VDC
POWER CIRCUIT
+5VDC
233
231
241
ANTENNA SELECT SWITCH
230
RECEIVING ANTENNA
130
131
220
AMPLITUDE MODULATION / FILTER CIRCUIT
221
223
136
137
WIDE BANDPASS FILTER
144
146
211
210
AMPLITUDE CONTROL CIRCUIT
213
118
NONVOLATILE MEMORY
148
FILTER BYPASS SWITCH
150
NARROW BANDPASS FILTER
200
SIGNAL GENERATING CIRCUIT
201
203
116
114
153
152
149
CONTROLLER
RAM
ROM
A/D CONVERTER
112
110
QUADRATURE FREQUENCY DISCRIMINATOR
156
167
169
165
163
FREQUENCY SYNTHESIS AND CONTROL CIRCUIT
160
161
159
120
USER INTERFACE
154
AM DATA SLICER
FM DATA SLICER
158

TRAINABLE RF TRANSMITTER HAVING EXPANDED LEARNING CAPABILITIES

BACKGROUND OF THE INVENTION

The present invention generally relates to trainable transmitters, and more particularly relates to vehicle-installed trainable transmitters capable of learning the carrier frequency, modulation scheme, and data code of a received radio frequency (RF) signal.

Trainable transmitters are known that are capable of learning the RF carrier frequency and code of a received RF signal for purposes of subsequently generating and transmitting a modulated RF signal having the learned characteristics on demand. Examples of such RF trainable transmitters are disclosed in U.S. Pat. Nos. 5,583,485; 5,614,885; and 5,379,453 and Italian Patent No. 1,261,150. Such trainable transmitters were designed for implementation in a vehicle accessory such that they can be used to learn the characteristics of a signal transmitted from an original transmitter associated with a garage door opening mechanism. When used in this manner, the trainable transmitter can effectively replace the original transmitter while providing a clean, neat appearance in the interior of the vehicle. Further, these trainable transmitters can be trained to learn more than one activation signal thereby eliminating the need to have more than one transmitting device within a vehicle.

Because some original garage door transmitters sold in the United States utilize different modulation schemes that affect the manner in which the received data code is best encoded and stored in the memory of the trainable transmitters, trainable transmitters were developed that distinguish between different modulation schemes present in a received signal in order to encode such signals in different manners. Commonly-assigned U.S. Pat. Nos. 5,479,155; 5,614,891; 5,661,804; and 5,686,903 disclose trainable transmitters having this added capability.

In the United States, the Federal Communications Commission (FCC) enforces regulations pertaining to the permissible power output of RF signals within certain frequency bands. In the United States, the FCC has designated the frequency band of 200 to 400 MHz for use by RF transmitters of a class including garage door opening transmitters. Because the FCC permits different power levels within this band based on the carrier frequency and duty cycle of the signal and because garage door opening transmitters may have carrier frequencies falling anywhere within this band, trainable transmitters of the type manufactured by the assignee preferably include variable attenuators or amplifiers for varying the amplitude of a transmitted signal in order to transmit the maximum power permitted by the FCC throughout the 200 to 400 MHz band. Trainable transmitters having this capability are described in commonly-assigned U.S. Pat. Nos. 5,442,340; 5,479,155; 5,614,891; and 5,686,903.

To enhance security of garage door opening mechanisms, manufacturers have implemented cryptographic algorithms in their original transmitters and receivers that transmit and respond to randomly varying codes. To enable a vehicle-installed trainable transmitter to effectively operate in such systems, a trainable transmitter was developed that has the capability of recognizing when a received signal has been originated from a transmitter that generates a code that varies with each transmission in accordance with a cryptographic algorithm. When such a variable code is recognized, the trainable transmitter determines which cryptographic algorithm is used to vary the code from one actuation to the next in order to generate and transmit the next code to which the receiver will respond. A trainable transmitter having this capability is disclosed in commonly-assigned U.S. Pat. No. 5,661,804.

Trainable transmitters of the type described above have found other applications and uses within a vehicle. For example, the receiving circuitry in such trainable transmitters may be used to receive and respond to an RF signal transmitted from a remote keyless entry (RKE) key fob to lock and unlock the vehicle's doors and to arm and disarm the vehicle's security system. Such trainable transmitters are disclosed in commonly-assigned U.S. Pat. Nos. 5,614,885; 5,619,190; 5,627,529; and 5,646,701. Additionally, as disclosed in U.S. Pat. No. 5,661,651, the receiving circuitry in a trainable transmitter may also be used to receive vehicle parameter data, such as tire pressure, from transmitters connected to parameter sensors that are mounted within the vehicle. Such an arrangement allows for various vehicle parameters to be monitored and displayed without requiring any additional wiring.

The trainable transmitters described above were developed primarily for use in North America. One problem encountered in developing a trainable transmitter for use in Europe arises from the use in Europe of RF carrier frequencies over a much greater bandwidth than is used in North America. For example, garage door manufacturers sell systems in Europe that transmit at frequencies between a first band of 27 and 40 MHz and between a higher second band of 418 and 433 MHz. The use of carrier frequencies that vary from one another so considerably, poses many practical problems when designing a trainable transmitter that must be capable of learning and subsequently transmitting signals at those carrier frequencies. One such problem relates to the fact that it is difficult to design a single antenna that is efficient at transmitting signals having carrier frequencies falling within both the first and second bands. To solve this problem, PCT Application No. WO 94/02920 discloses a trainable transmitter including two different transmitting antennas for transmitting signals in the two respective frequency bands, as well as a third antenna for receiving signals from within both frequency bands. Another problem relating to the transmission of signals in the two frequency bands arises from the fact that voltage controlled oscillators (VCO) used to generate a carrier signal at such frequencies, become extremely complex and expensive if required to generate carrier signals at frequencies over such a broad range. To avoid this problem, the trainable transmitter disclosed in PCT Application No. WO 94/02920, uses two separate VCOs that may be used to generate the carrier signals within the lower and upper frequency bands. However, the use of two oscillators nonetheless adds to the expense of the device.

In many countries in Europe, garage door opening systems are sold that transmit, receive, and respond to frequency modulated (FM) RF signals. Because essentially all garage door opening systems sold in North America transmit, receive, and respond to amplitude modulated (AM) RF signals and because the trainable transmitters described above (with the exception of those described in PCT Application No. WO 94/02920 and Italian Patent No. 1,226,150) were developed primarily for use in North America, those trainable transmitters do not have the capacity to learn and retransmit an FM signal. The trainable transmitters disclosed in PCT Application No. WO 94/02920 and Italian Patent No. 1,261,150, do not have the capability of receiving, learning, and retransmitting an FM signal. Thus, the prior trainable transmitters are not capable of learning all the various signals used in European garage door opening systems.

An additional problem in developing a trainable transmitter for use in Europe, is to provide the capability in the trainable transmitter to transmit the learned signals at the maximum power levels permitted under all the different regulations of the various countries within Europe. Insofar as the above-described trainable transmitters only vary the amplitude of the transmitted signals based upon the regulations passed by the United States government (if the amplitude is varied at all), and the regulations imposed in many countries in Europe are different from those in the United States, such prior trainable transmitters do not account for these different regulations and therefore do not transmit signals at the maximum power levels allowed by each European country.

SUMMARY OF THE INVENTION

It is an aspect of the present invention to provide a trainable transmitter capable of learning all the variations of signals used in Europe for remotely controlling garage door opening systems as well as other devices that may be remotely controlled in response to an RF signal. It is therefore another aspect of the present invention to solve the above-identified problems associated with prior trainable transmitters with respect to learning the various forms of signals currently used in Europe. An additional aspect of the invention is to provide a trainable transmitter for learning the characteristics of a received FM RF signal and for subsequently transmitting an FM RF signal having the learned characteristics to a remote device.

To achieve these and other aspects and advantages, the trainable transmitter according to the present invention comprises a receiver for receiving an FM RF signal, a controller coupled to the receiver for identifying and storing signal characteristics including the RF carrier frequency code of the received modulated RF signal, and a transmitting circuit coupled to the controller for receiving the stored signal characteristics and for generating and transmitting an FM RF signal having the learned signal characteristics. By also providing means for discriminating between a received FM signal and a received AM signal, the trainable transmitter of the present invention may learn and retransmit both types of signals.

Another aspect of the present invention is to provide a trainable transmitter that transmits the maximum power levels permitted under the regulations of the country in which the trainable transmitter is to be operated. To achieve this and other aspects and advantages of the present invention, a trainable transmitter constructed in accordance with the present invention comprises a receiver for receiving an activation signal, and a memory having a plurality of sets of amplitude control data stored therein, each set of amplitude control data including amplitude control data representing different permissible amplitude levels for different countries in which the trainable transmitter may be operated. The transmitter further includes means for allowing the selection of one of the sets of amplitude control data based upon the country in which the trainable transmitter is to be operated, and a controller operable in a learning mode and an operating mode. The controller is coupled to the receiver for generating and storing data corresponding to the RF carrier frequency and code of the received activation signal when in the learning mode. When in the operating mode, the controller provides output data which identifies the RF carrier frequency and code of the received activation signal and amplitude control data read from the selected set of amplitude control data stored in the memory. The transmitter further includes a signal generator coupled to the controller for receiving output data and for generating a modulated RF carrier signal representing the received activation signal. Additionally, the trainable transmitter includes an amplitude control circuit coupled to the signal generator and to the controller for receiving amplitude control data from the controller to selectively control the amplitude of the modulated RF carrier signal received from the signal generator at an amplitude level indicated by the received amplitude control data, and for transmitting an amplitude-controlled output signal.

Yet another aspect of the invention is to provide a trainable transmitter capable of transmitting signals at both the high and low frequency bands used in Europe without requiring the use of two separate VCOs or a complex and expensive VCO that generates signals throughout both high and low frequency bands. To achieve this and other aspects and advantages, a trainable transmitter constructed in accordance with the present invention comprises a receiver for receiving an RF signal, a controller coupled to the receiver for identifying the characteristics of the RF signal including an RF carrier frequency and code of the received RF signal. Additionally, the trainable transmitter includes a signal generating circuit coupled to the controller for receiving the stored signal characteristics and for generating and transmitting a modulated RF signal having the learned signal characteristics. The signal generating circuit includes an oscillating circuit for generating frequencies within a first higher frequency band and a frequency divider selectively coupled between an output terminal of the signal generating circuit and the oscillator to selectively reduce the frequency of the signal output from the signal generating circuit to frequencies within a second lower frequency band, the frequency band being selected by the controller.

These and other features, advantages, and objects of the present invention will be further understood and appreciated by those skilled in the art by reference to the following specification, claims, and appended drawings.

BRIEF DESCRIPTION OF THE DRAWINGS

In the drawings:

FIG. 5 is an electrical circuit diagram in partial block in schematic form, of the circuitry forming a trainable transmitter constructed in accordance with the present invention;

DETAILED DESCRIPTION OF PREFERRED EMBODIMENT

Figure 2:
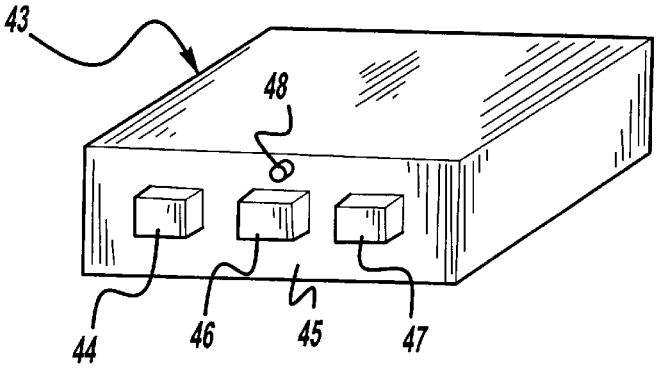
FIG. 2 is a perspective view of a trainable transmitter of the present invention.

FIG. 2 shows a trainable transmitter 43 of the present invention. Trainable transmitter 43 includes three pushbutton switches 44, 46, and 47, a light emitting diode (LED) 48, and an electrical circuit board and associated circuits (FIGS.

Figure 1:
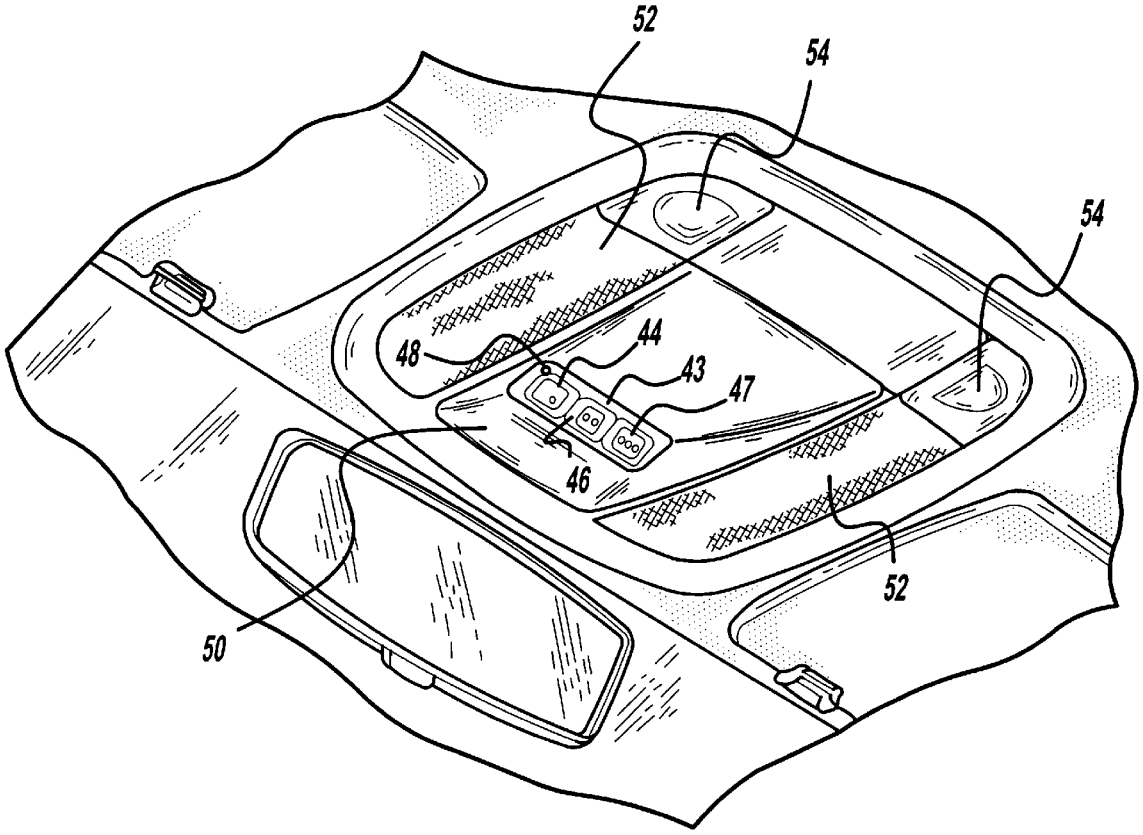
FIG. 1 is a fragmentary perspective view of a vehicle interior having an overhead console for housing the trainable transmitter of the present invention.

5 and 6) that may be mounted in a housing 45. As explained in greater detail below, switches 44, 46, and 47 may each be associated with a separate garage door or other device to be controlled. Trainable transmitter housing 45 is preferably of appropriate dimensions for mounting within a vehicle accessory such as an overhead console 50 as shown in FIG. 1. In the configuration shown in FIG. 1, trainable transmitter 43 includes electrical conductors coupled to the vehicle's electrical system for receiving power from the vehicle's battery. Overhead console 50 includes other accessories such as map reading lamps 52 controlled by switches 54. It may also include an electronic compass and display (not shown).

Figure 3:
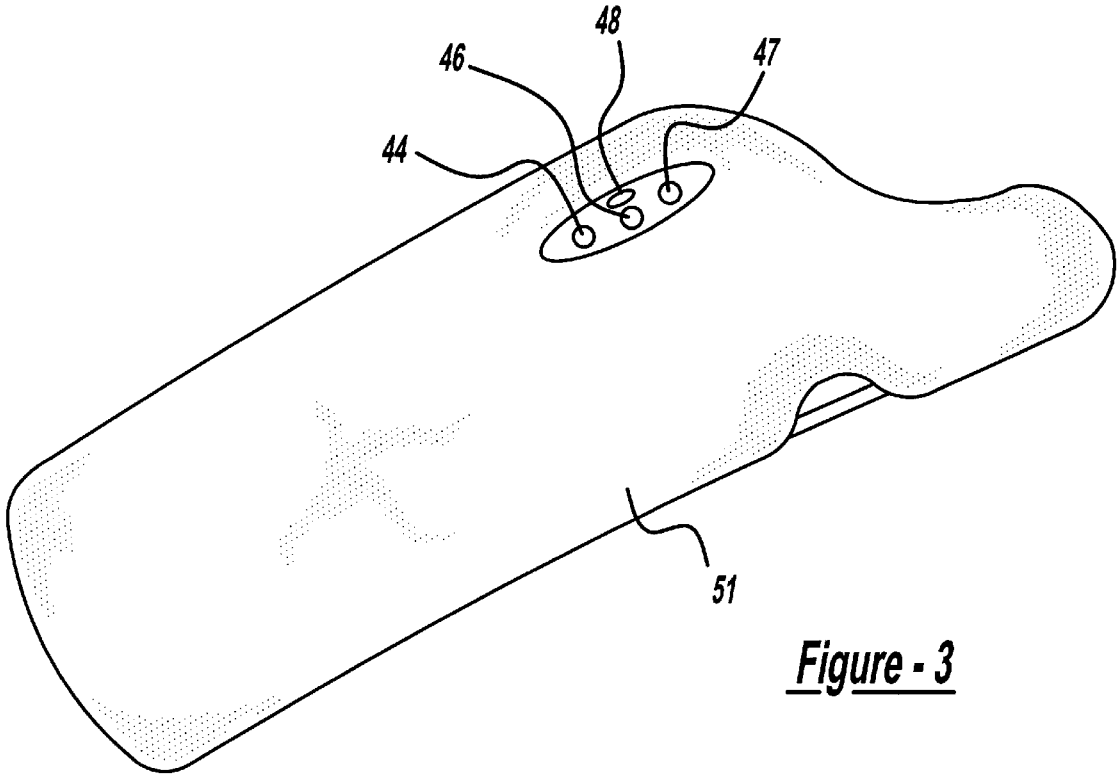
FIG. 3 is a perspective view of a visor incorporating the trainable transmitter of the present invention.
Figure 4:
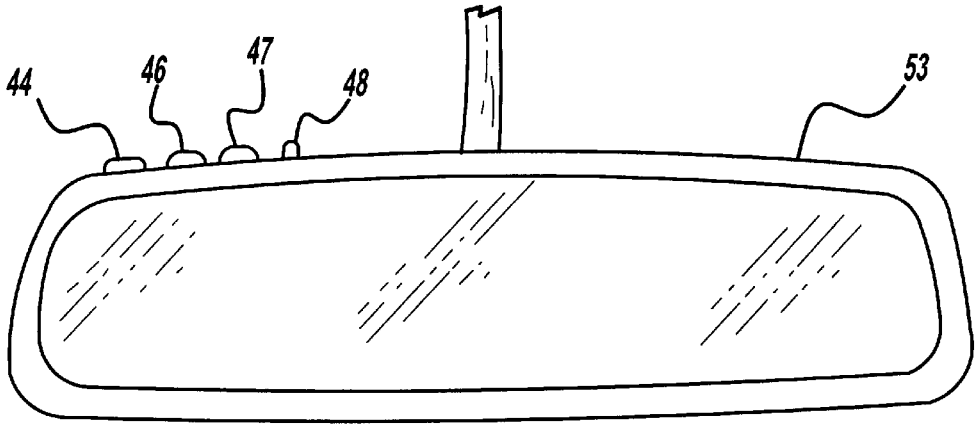
FIG. 4 is a perspective view of a mirror assembly incorporating the trainable transmitter of the present invention.

Trainable transmitter 43 may alternatively be permanently incorporated in a vehicle accessory such as a visor 51 (FIG. 3) or a rearview mirror assembly 53 (FIG. 4). Although trainable transmitter 43 has been shown as incorporated in a visor and mirror assembly and removably located in an overhead console compartment, trainable transmitter 43 could be permanently or removably located in the vehicle's instrument panel or any other suitable location within the vehicle's interior.

System Hardware

FIG. 5 shows the electrical circuit 100 of trainable transmitter 43 in block and schematic form. Electrical circuit 100 includes a microprocessor-based controller 110 preferably including an 8-bit analog-to-digital (A/D) converter 112, a read-only memory (ROM) 114, and a random access memory (RAM) 116. It will be appreciated by those skilled in the art that A/D converter 112, ROM 114, and RAM 116 may be provided as separate elements connected to a microprocessor or may be formed within the microprocessor itself as shown in FIG. 5. Similarly, a nonvolatile memory (NVM) 118 may be provided and connected separate from controller 110 or may be provided as an integral part of the microprocessor forming controller 110. A suitable controller for this purpose is microcontroller PIC 16C73A available from Microchip Technology Inc. NVM 118 preferably provides at least 4 k bytes of RAM.

Electrical circuit 100 further includes a user interface 120 coupled to controller 110. User interface 120 generically refers to switches 44, 46, and 47 as well as an indicating device such as LED 48. It will be appreciated, however, that user interface 120 may include a display for displaying more explicit instructions and information to the user. As described in more detail below, the switches in user interface 120 are provided to input information into controller 110 causing it to enter either a transmitting mode or a training mode with respect to a channel associated with the activated pushbutton switch. In the preferred implementation of the present invention, controller 110 associates one separate channel with each of switches 44, 46, and 47. When one of switches 44, 46, or 47 is actuated, controller 110 monitors how long the switch is actuated to determine whether it is to transmit a signal using the associated stored channel data or to enter a training mode whereby it learns and stores characteristics of a received RF signal A transmitted from an original transmitter 135 associated with a remotely actuated device 140 or 142.

Figure 6:
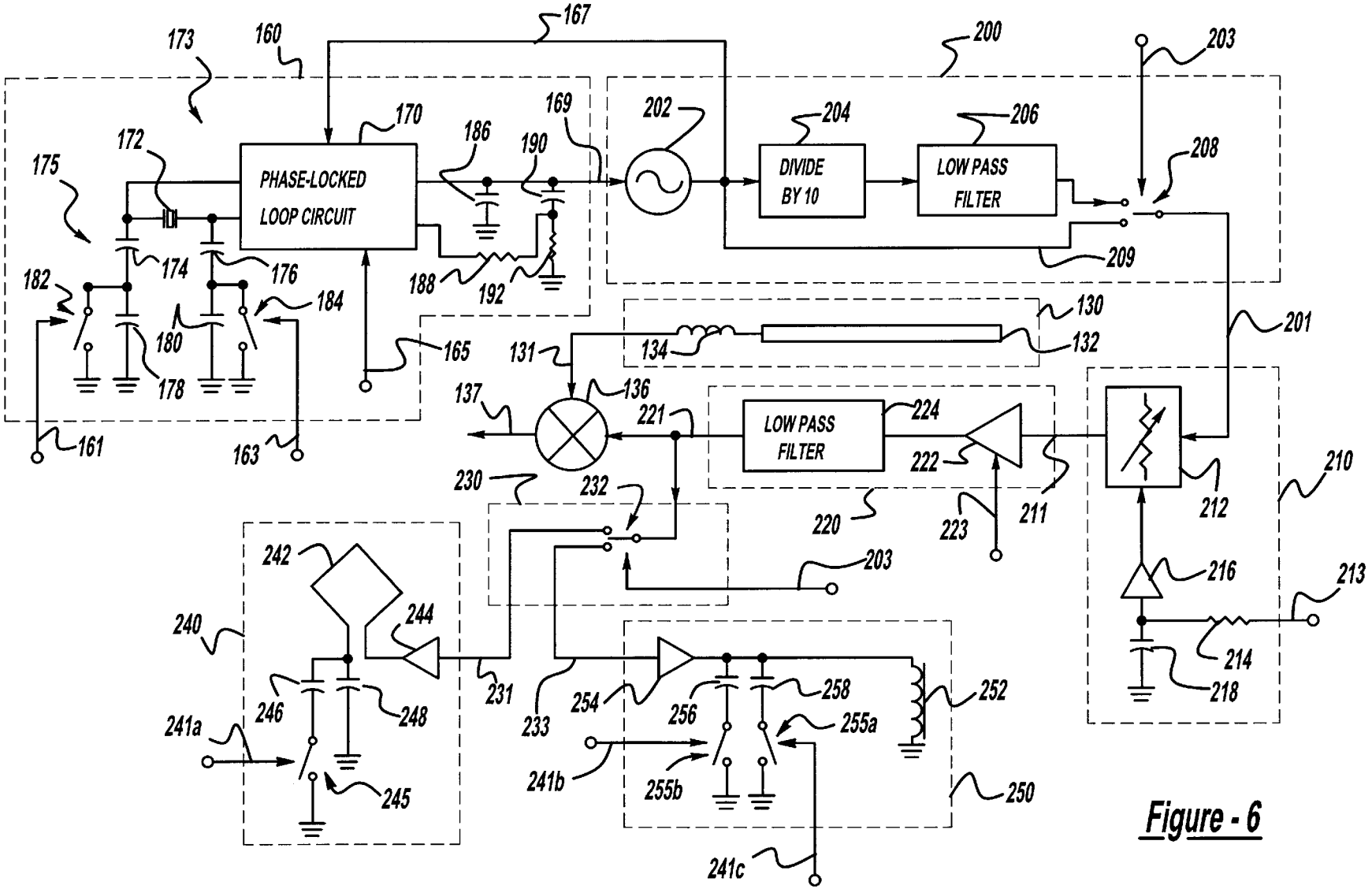
FIG. 6 is a detailed electrical circuit diagram in partial block and schematic form, of the circuitry forming a portion of the trainable transmitter constructed in accordance with the present invention.

To receive an RF signal A from original transmitter 135, trainable transmitter circuit 100 is provided with a receiving antenna 130, which converts the received electromagnetic RF signal into an electrical RF signal that is output on line 131 to a mixer 136. As shown in FIG. 6, receiving antenna 130 may be formed of a printed strip antenna 132 connected in series with an inductor 134.

Mixer 136 mixes the received RF signal supplied on line 131 with a reference signal supplied on line 221. As explained in more detail below, controller 110 controls a signal generator to generate the reference signal supplied to mixer 136 on line 221. The output of mixer 136 is provided on line 137 to the input of a wide-band bandpass filter 144. Wide-band bandpass filter 144 is preferably constructed to allow signals having frequencies at 455 kHz±400 kHz to pass therethrough. Thus, wide-band bandpass filter 144 only outputs a signal when the difference between the frequency of the reference signal supplied to mixer 136 on line 221 and the RF carrier frequency of the received RF signal supplied to mixer 136 on line 131 is between 55 kHz and 855 kHz.

When a signal is output from wide-band bandpass filter 144, it is amplified by an amplifier 146 prior to being supplied to the input of a filter bypass switch 148. Filter bypass switch 148 is controlled by controller 110 via line 149 to selectively connect or bypass a narrow-band bandpass filter 150. Narrow-band bandpass filter 150 is preferably constructed to allow signals having frequencies of 455 kHz±3 kHz to pass therethrough. Thus, depending upon the state of filter bypass switch 148, the output of narrow-band bandpass filter 150 or the amplified output of wide-band bandpass filter 144 is supplied to the input of a limiter amplifier 152. One output of limiter amplifier 152 is coupled to the input of a quadrature frequency discriminator 156, which converts an FM signal into an analog binary signal. In a preferred implementation, mixer 136, amplifier 146, limiter amplifier 152, and quadrature frequency discriminator 156 are provided in the form of integrated circuit part No. SA625DK available from Phillips Semiconductor. With such an implementation, however, the ceramic discriminator typically used in such quadrature frequency discriminators (156) is connected external to such an integrated circuit.

An FM data slicer 158 is coupled to the muted and unmuted audio outputs of quadrature frequency discriminator 156 to digitize the analog binary output signal prior to supplying the signal to controller 110 for analysis and storage. An AM data slicer 154 is provided to digitize a received signal strength indicator (RSSI) AM data output from integrated circuit part No. SA625DK. The RSSI signal is essentially an analog envelope signal corresponding to the amplitude of the received RF signal but having the carrier signal components removed. AM data slicer 154 digitizes the AM signal and supplies the digitized signal to controller 110 for further processing. The RSSI output is also supplied to A/D converter 112 in controller 110. As explained further below, controller 110 determines whether a received signal is AM or FM based upon the levels of the RSSI signals obtained from the received signal.

As mentioned above, trainable transmitter circuit 100 further includes a signal generator 159 for generating reference signals that are supplied to mixer 136. Signal generator 159 includes a signal generating circuit 200 and a frequency synthesis and control circuit 160. As shown in FIG. 6, the primary component of signal generating circuit 200 is a VCO 202 that generates an RF signal having a frequency that is a function of the voltage level applied to its frequency control input terminal. The voltage level applied to the frequency control input terminal of VCO 202 is controlled by frequency synthesis and control circuit 160, which primarily includes a phase-locked loop (PLL) circuit 170. PLL circuit 170 receives frequency control data from controller 110 via line 165, and responds to this frequency control data by making any necessary adjustments to the voltage level applied to the frequency control input terminal of VCO 202 via line 169. More specifically, PLL circuit 170 divides the frequency of a reference signal supplied from a reference signal generating circuit 173 and the frequency of the VCO output received on a feedback line 167 in accordance with a ratio dictated by the frequency control data. PLL circuit 170 then compares the divided reference frequency with the divided VCO output frequency to determine whether the voltage applied on line 169 to the frequency control input terminal of VCO 202 needs to be increased or decreased to adjust the VCO's output frequency to correspond to the divided reference frequency.

As shown in FIG. 6, the reference signal generating circuit 173 includes a crystal oscillator 172, which preferably oscillates at a fixed frequency of 20 MHz, and a circuit 175 functioning as frequency deviation means for introducing frequency deviation for FM transmissions. During the training mode and during transmission of AM signals, the frequency deviation circuit 175 is not operated such that the frequency of the reference signal supplied to PLL circuit 170 is not altered. Frequency deviation circuit 175 includes first and second capacitors 174 and 176 coupled to opposite ends of crystal oscillator 172 and third and fourth capacitors 178 and 180 that are selectively coupled in series between respective first and second capacitors 174 and 176 and ground. To selectively bypass third and fourth capacitors 178 and 180, first and second switches 182 and 184 are connected in parallel with capacitors 178 and 180. Switches 182 and 184 are driven between conductive and nonconductive states by frequency modulation data provided from controller 110 via lines 161 and 163, respectively. By utilizing capacitors having two different capacitances for capacitors 178 and 180, two different deviation frequencies may be imposed in the generated signal for FM modulation. In a preferred construction, capacitors 174 and 176 have a capacitance of 33 pF, capacitor 178 has a capacitance of 22 pF, and capacitor 180 has a capacitance of 12 pF. Provided crystal oscillator 172 generates a signal with a frequency of 20 MHz, controller 110 may obtain a deviation frequency of 4.6 kHz in the reference signal supplied to PLL circuit 170 by applying FM modulation data to switch 182 via line 161 and may obtain a 2.8 kHz deviation by applying the FM modulation data to switch 184 via line 163. By introducing such deviation frequencies to the reference signal supplied to PLL circuit 170, deviation frequencies of 7 kHz and 60 kHz for low-band and high-band signals, respectively, may be introduced in the RF signal to be transmitted. The manner by which controller 110 determines which, if any, of lines 161 and 163 to apply FM modulation data, is described in detail below.

As shown in FIG. 6, frequency synthesis and control circuit 160 further includes a circuit coupled to the output of PLL circuit 170 including a capacitor 186 coupled between output line 169 and ground, a capacitor 190 coupled in series with a resistor 192 between output line 169 and ground, and a resistor 188 coupled between PLL circuit 170 and a node between capacitor 190 and resistor 192. The circuit coupled to the output of PLL circuit 170 is provided to prevent over-responsiveness of VCO 202 to the voltage level output from PLL circuit 170. In a preferred embodiment, PLL circuit is implemented using part No. LMX2337 available from National Semiconductor Corporation.

As described above, signal generating circuit 200 includes VCO 202. VCO 202 is preferably constructed to output frequencies within the range of 250 MHz to 450 MHz. Given that this frequency range corresponds to the frequency range of conventional trainable transmitters used for transmitting signals in North America, any VCO used in such devices may be used to implement VCO 202 in accordance with this invention. A specific example of one such VCO is disclosed in U.S. Pat. No. 5,686,903 issued on Nov. 11, 1997.

The signal generated by VCO 202 is supplied via line 209 to a switch 208 (FIG. 6) that is responsive to a frequency band select signal supplied by controller 110 on line 203. When controller 110 selects the high frequency band (250 MHz to 450 MHz), switch 208 directly connects VCO output line 209 to signal generating circuit output line 201 such that the output signal of VCO 202 is directly output from signal generating circuit 200. To enable signal generating circuit 200 to output signals having frequencies in a lower frequency band of 27 MHz to 40 MHz, signal generating circuit 200 is provided with a divide by 10 circuit 204 (also referred to herein as a frequency divider circuit), which receives the signal generated by VCO 202 and generates an output signal having a frequency that is one-tenth of that output from VCO 202. Thus, given a frequency range for VCO 202 of 250 MHz to 450 MHz, signals may be generated by divide by 10 circuit 204 having frequencies anywhere in the range of 25 MHz to 45 MHz. A low pass filter 206 is preferably coupled to the output of divide by 10 circuit 204 to remove undesired harmonics that may be present in the output of circuit 204. By applying a low frequency band select signal to signal generating circuit 200 via line 203, controller 110 may select the lower (i.e., 25 MHz to 45 MHz band) through the actuation of switch 208 to couple the output of low pass filter 206 to output line 201.

As shown in FIGS. 5 and 6, the signal generated by signal generating circuit 200 is passed through an amplitude control circuit 210 and an amplitude modulation/filter circuit 220 prior to being applied via line 221 to an input of mixer 136. As discussed further below, amplitude control circuit 210 is provided to adjust the amplitude of the signal generated by signal generating circuit 200 in response to amplitude control data supplied from controller 210 via line 213. During a training mode, controller 110 maintains the amplitude of the reference signal at a fixed optimum level for use by mixer 136.

Amplitude modulation/filter circuit 220 is provided to modulate and filter the signal output from amplitude control circuit 210 on line 211 in response to AM modulation data generated by controller 110 on line 223. During the training mode, controller 110 generates an appropriate nonvarying signal and supplies this signal to amplitude modulation/filter circuit via line 223 to cause circuit 220 to pass the signal output from amplitude control circuit 210 on line 211 to pass directly through circuit 220 onto line 221 without being modulated. In this manner, mixer 136 receives a reference signal during the training mode that is neither amplitude modulated by circuit 220 or FM by frequency deviation circuit 175. Prior to describing the detailed operations of circuit 100 during a training mode, the portion of circuit 100 that functions to transmit a modulated signal is first described below.

The transmitting circuitry of trainable transmitter circuit 100 includes the aforementioned frequency synthesis and control circuit 160, signal generating circuit 200, amplitude control circuit 210, and amplitude modulation/filter circuit 220, and additionally includes an antenna select switch 230, a high-band transmit antenna 240, and a low-band transmit antenna 250. As explained in more detail below, during a training mode, controller 110 identifies the RF carrier frequency and data code of a received RF signal A and identifies whether the received signal is an AM or FM signal. Data representing the identified carrier frequency, data code, and modulation type are stored by controller 110 for subsequent use to transmit a signal having these characteristics during a transmit mode. As noted above, controller 110 enters a transmit mode in response to the actuation of one of the switches of user interface 120 for a period that does not exceed a predetermined time threshold. Thus, when one of switches 44, 46, or 47 is actuated for transmission, controller 110 reads from NVM 118 the carrier frequency, data code, and modulation type stored for the channel associated with the actuated switch.

If the signal to be transmitted is an AM signal, controller 110 supplies frequency control data representing the desired carrier frequency to frequency synthesis and control circuit 160 via line 165 while holding switches 182 and 184 of frequency deviation circuit 175 in their current state by applying a non-altering voltage level on lines 161 and 163. Further, depending upon whether the carrier frequency to be generated is in the high or low band, controller 110 transmits the appropriate band selection signal to signal generating circuit 200 via line 203 to either bypass or output the signal from divide by 10 circuit 204. Thus, by applying the appropriate signals on lines 161, 163, 165, and 203, controller 110 may cause signal generator 159 to generate a signal having a nonvarying carrier frequency corresponding to the carrier frequency of an RF signal A received during the training mode.

As described above, amplitude control circuit 210 is responsive to amplitude control data supplied from controller 110 on line 213 to adjust the amplitude of the signal received from signal generating circuit 200 via line 201. As shown in FIG. 6, amplitude control circuit 210 may include a variable attenuator 212 and a buffer circuit including a resistor 214 coupled to line 213, a capacitor 218 coupled between a second terminal of resistor 214 and ground, and a buffer 216 coupled between the second terminal of resistor 214 and an attenuation level control terminal of attenuator 212. Although the use of an attenuator is shown and described herein, it will be appreciated by those skilled in the art that a variable gain amplifier could likewise be used to increase, rather than decrease, the amplitude of the signal received from the signal generated. The amplitude control data delivered by controller 110 may be in the form of a pulse width modulated signal having a pulse width corresponding to the desired attenuation level.

To enable the trainable transmitter of the present invention to comply with the regulations in each and every country in which it may be operated, a plurality of sets of amplitude control data are preferably stored in NVM 118 for subsequent selection by an automobile dealer, distributor, or the vehicle owner. Each set of amplitude control data preferably corresponds to maximum amplitude levels for RF signals transmitted by this type of device that are permitted for one or more of the plurality of countries in which the device may be operated. Typically, the maximum permitted transmitted amplitude levels vary as a function of carrier frequency. Therefore, for a given set of amplitude control data, controller 110 may select the appropriate amplitude control data corresponding to the carrier frequency of the signal to be transmitted.

To allow for the selection of a set of amplitude control data corresponding to the particular country in which the device is to be operated, user interface 120 may be configured to allow a user or automobile dealer to identify which country the device will be operated such that controller 110 may respond to such input by selecting and thereafter utilizing the appropriate set of amplitude control data.

As shown in FIG. 6, amplitude modulation/filter circuit 220 includes a modulator 222 in the form of an amplifier or gate that is capable of modulating the amplitude of the RF carrier signal input thereto on line 211 in response to an AM signal supplied from controller 110 on line 223. The modulated signal output from modulator 222 is provided to a low pass filter 224 to remove any undesired harmonics from the modulated signal. Low pass filter 224 preferably has a cut-off frequency of approximately 433 MHz. Although low pass filter 206 is provided in signal generating circuit 200, this filter is not utilized for high-band signal generation as a result of the bypass 209. Such a construction is preferable insofar as low pass filter 206 may then be configured to have a cut-off frequency of 57 MHz, for example, to more closely filter the lower frequencies passing therethrough without blocking any frequency signals intended to be transmitted in the higher frequency band.

As shown in FIG. 5, trainable transmitter circuit 100 utilizes two different transmitting antennas. Due to the need to transmit signals in the higher and lower frequency bands discussed above, two different types of antennas are utilized for transmitting in these respective bands in order to maximize the efficiency of signal transmission. Antenna select switch 230 is provided to selectively supply the modulated RF signal output from amplitude modulation/filter circuit 220 to either high-band transmit antenna 240 or low-band transmit antenna 250 via lines 231 or 233, respectively, in response to the frequency band select signal output from controller 110 on line 203.

As shown in FIG. 6, high-band transmit antenna 240 preferably includes a high-band loop antenna 242 having one terminal connected to input line 231 via a high-band transmit amplifier 244, and its other end coupled to ground via one or more capacitors 246 and 248. Preferably, antenna 240 is a dynamically tunable antenna such that controller 110 may control the tuning of antenna 240 via line 241*a* to adjust the impedance of the antenna to most efficiently transmit a signal having the selected carrier frequency. As shown in FIG. 6, antenna 242 may be tuned by selectively connecting capacitor 246 in parallel with capacitor 248 using a switch 245 that is responsive to a tuning control signal supplied from controller 110 via line 241*a*. It will be appreciated that other configurations for dynamically tuning such an antenna may be used including the configuration disclosed in U.S. Pat. No. 5,686,903. Further, if antenna 240 is mounted in a visor, as illustrated in FIG. 3, a passive strip is preferably mounted in the visor in the manner disclosed in U.S. Pat. No. 5,596,316 so as to increase the efficiency of transmission.

Low-band transmit antenna 250 preferably includes a Ferrite core antenna 252 having one end connected to ground and the other end connected to the output of a low-band transmit amplifier 254, which has its input coupled to input line 233. Ferrite core antenna 252 is preferably used to transmit the signals having frequencies in the lower band due to its improved transmission performance characteristics with respect to signals having frequencies within the lower band. Like high-band transmit antenna 240, low-band transmit antenna 250 is preferably a dynamically tunable antenna. Such tuning may be accomplished by providing two capacitors 256 and 258, which may be selectively and independently coupled between the output of amplifier 254 and ground. To selectively couple such capacitors, respective switches 255*a* and 255*b* are coupled between the capacitors and ground that are responsive to control signals transmitted on lines 241*b* and 241*c*.

To transmit an FM signal, controller 110 selects the required carrier frequency by supplying frequency selection data on line 165 and supplying a frequency band select signal on line 203. To modulate the generated carrier signal, controller 110 reads the data code from memory and supplies the data code to either switch 182 or switch 184 in frequency synthesis and control circuit 160 via lines 161 or 163, respectively. Controller 110 determines which switch 182 or 184 to apply the data code based upon the frequency band in which the carrier frequency falls. For example, the data code is supplied to switch 182 for low-band transmissions and to switch 184 for high-band transmissions. By altering one of switches 182 and 184 between conductive and nonconductive states, an appropriate deviation frequency is introduced into the carrier signal generated by signal generating circuit 200 in correspondence with the data code read from memory. When the generated signal is an FM signal, amplitude modulation filter circuit 220 is supplied with an AM modulation signal of constant value such that the signal generated by signal generating circuit 200 is not amplitude modulated.

System Operation

Figure 7A:
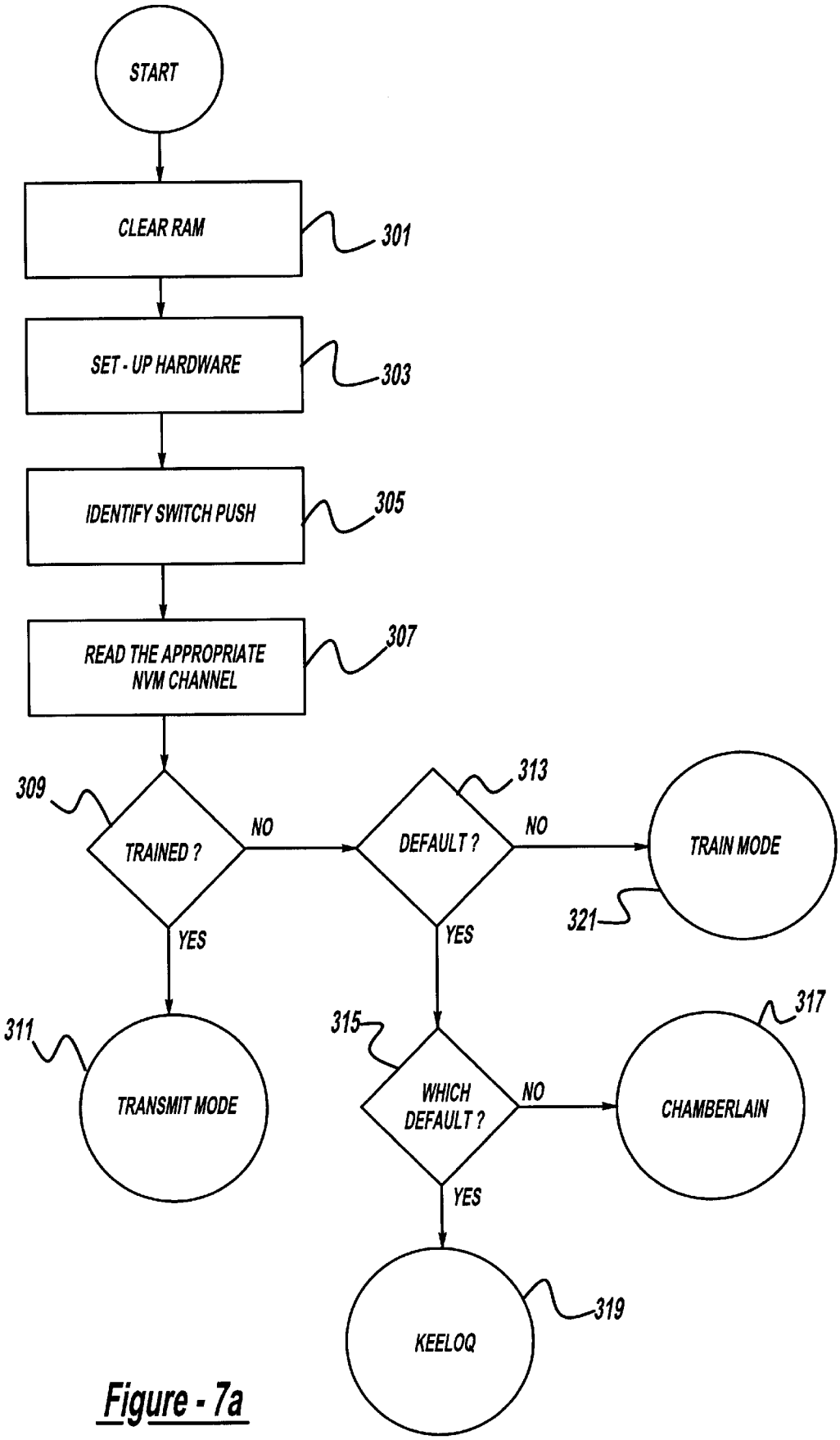
FIGS. 7A–7D are flowcharts illustrating the operation of the trainable transmitter of the present invention.

Having described the trainable transmitter circuit 100 of the present invention, a description of the operation thereof is provided below with reference to FIGS. 7A–7D. As shown in FIG. 7A, during initial start-up, controller 110 first clears RAM 116 (step 301) and performs an initial status inquiry of the hardware connected to controller 110 (step 303). Next, controller 110 determines whether one of the switches (44, 46, or 47) has been actuated or whether any other user input signal has otherwise been received from user interface 120 (step 305). If a switch has been actuated, controller 110 looks for and reads any data contained in nonvolatile memory 118 stored in a location thereof corresponding to the channel associated with the actuated switch (step 307). In step 309, controller 110 determines whether the trainable transmitter has been trained with respect to the selected channel. If the trainable transmitter has been trained, controller 110 transmits a signal B1 or B2 depending upon the frequency band in which the carrier signal falls (step 311). The details of the manner in which trainable transmitter circuit 100 transmits a signal is described below with reference to FIG. 7D.

If the trainable transmitter has not previously trained the channel associated with the actuated switch, controller 110 then determines in step 313 whether the associated channel memory has stored therein any default signal characteristics data. If default signal characteristics data is stored in the associated channel memory, controller 110 then determines whether the stored default data is data for a system manufactured by The Chamberlain Group, Inc. (step 317) or a system manufactured by Keeloq (step 319). Based upon this determination, the trainable transmitter of the present invention may generate different signals based upon the stored characteristics and/or associated cryptographic algorithm for subsequently transmitting a signal in the manner described below with reference to FIG. 7D.

Figure 7B:
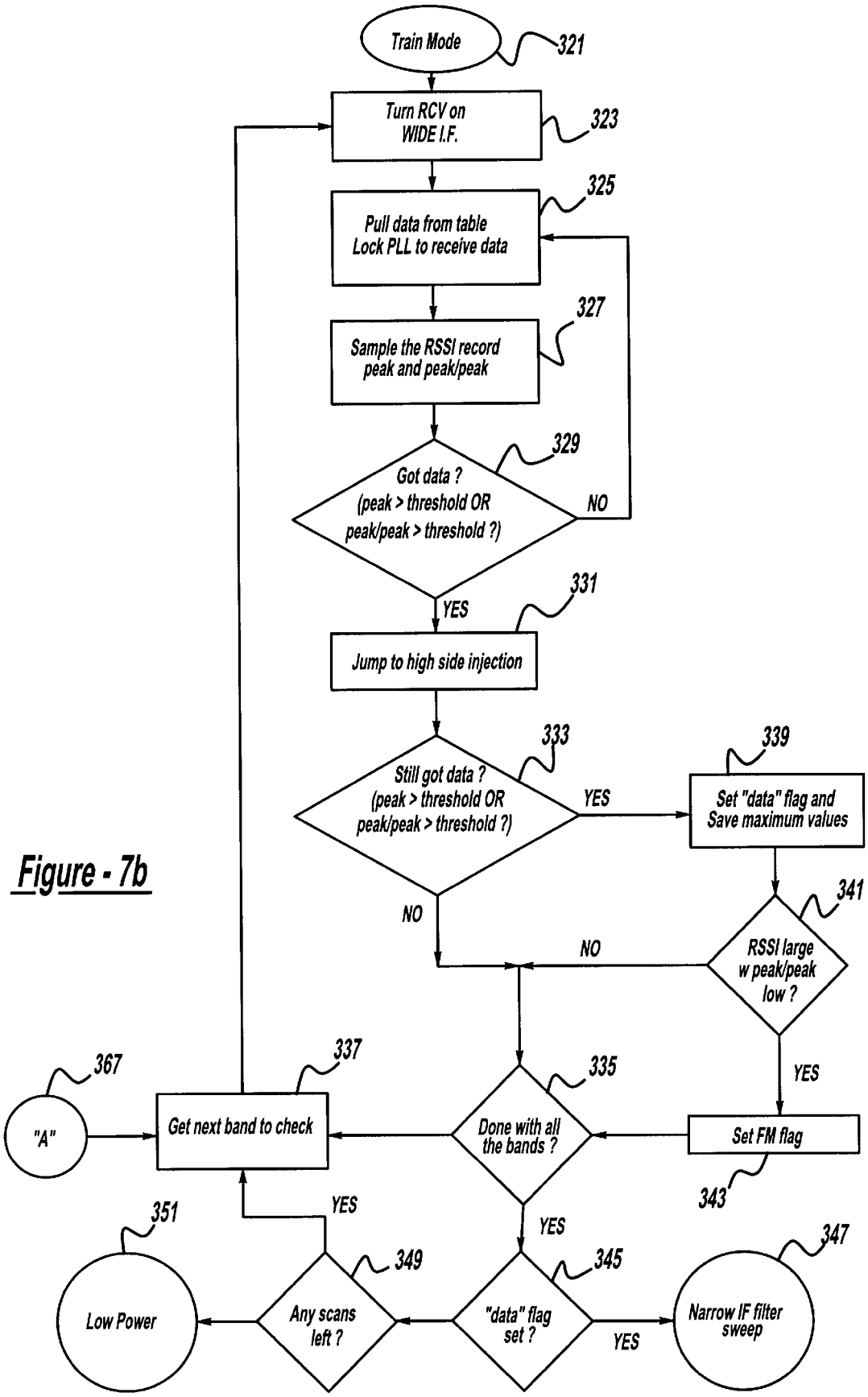

If the channel associated with the actuated switch has not been trained and does not have stored therein any default data, controller 110 enters a training mode (step 321) in which it performs the operations described below with reference to FIGS. 7B and 7C. As shown in FIG. 7B, when controller 110 is in a training mode, it first transmits a signal on line 149 to filter bypass switch 148 causing switch 148 to bypass narrow-band bandpass filter 150 (step 323). With narrow-band bandpass filter 150 bypassed, an intermediate frequency (IF) signal is passed to amplifier 152 and controller 110 for any received RF signal A having a carrier frequency within 455 kHz±400 kHz of the carrier frequency of the reference signal that is generated and applied to mixer 136 on line 221. Thus, to identify the carrier frequency of a received RF signal A, controller 110 varies the carrier frequency of the reference signal until it detects a signal output from amplifier 152 on line 153.

More specifically, controller 110 reads frequency data included in a table stored in NVM 118 and outputs this frequency data on lines 165 and 203 to cause the signal generator to generate a reference signal having a specified carrier frequency (step 325). The table of frequency data stored in NVM 118 preferably includes a list of frequency data corresponding to the carrier frequencies known to be used in commercially-available garage door opening systems. In Europe, such carrier frequencies are 27, 30, 40, 418, and 433 MHz. More precisely, the frequency data corresponds to carrier frequencies that are 455 kHz below the known carrier frequencies such that the carrier frequency of the generated reference signal is most likely to produce a detectable signal after passing through mixer 136 and filters 144 and 150.

While the reference signal is generated and supplied to mixer 136, controller 110 samples the RSSI signal supplied on line 153 to A/D converter 112. Controller 110 then records the peak values of the received RSSI signal as well as the peak/peak variations in the RSSI signal (step 327). In step 329, controller 110 determines whether data has been received by determining whether the recorded peaks of the RSSI signal exceed a threshold level or whether the peak/peak variation exceeds a threshold. If data is not present, controller 110 returns to step 325 to read the next set of frequency data from the frequency table stored in NVM 118. Steps 325–329 are repeated stepping through each of the frequencies in the frequency table until controller 110 determines in step 329 that data is present on line 153.

When controller 110 determines that data is present in step 329, controller 110 changes the frequency data applied on line 165 to cause the signal generator to generate a reference signal having a carrier frequency that is increased by 910 kHz (2×455 kHz) (step 331). If the previously-generated reference signal had a carrier frequency that was 455 kHz below the carrier frequency of the received RF signal A, data should once again be detected when the reference carrier frequency is increased to be 455 kHz above the carrier frequency of the received RF signal A since the difference between the frequencies of the reference signal and the received RF signal would still be 455 kHz. Thus, to confirm the first reference frequency was below, rather than above, the carrier frequency of the received RF signal, controller 110 determines in step 333 whether data is still present when the reference carrier frequency is increased to then potentially be above the carrier frequency of the received RF signal.

If, in step 333, controller 110 determines that data is no longer present, controller 110 checks whether it has generated reference signals at each frequency identified in the frequency table stored in NVM 118 (step 335). If additional frequencies remain, controller 110 gets the next frequency from the table (step 337) and returns to steps 323–329 to continue to look for data at the frequencies listed in the frequency table. If controller 110 determines in step 335 that it has generated a reference signal corresponding to each frequency stored in the frequency table, it checks in step 345 whether the data flag has been set (discussed below). If the data flag has not been set, controller 110 determines in step 349 whether it has scanned through each of the frequencies identified in the frequency table a predetermined number of times. For example, the trainable transmitter may be configured to scan through the entire list of frequencies in the frequency table twenty times before determining that no signal is present to which the device may be trained. If there are scans left to perform, controller 110 gets the next frequency from the table in step 337 and returns to steps 323–329 to detect the presence of data. If there are no scans left to perform, controller 110 signals user interface 120 to indicate to the user that training was unsuccessful and then controller 110 enters a low-power sleep state until it subsequently detects the actuation of a switch (step 351).

When controller 110 detects the presence of data in step 329 and subsequently verifies its presence in step 333 after increasing the reference signal frequency to one above that of the received RF signal, controller 110 sets a data flag and saves the maximum values of the recorded peaks of the RSSI signal along with the maximum peak-to-peak variation of the value of the RSSI signal (step 339). In step 341, controller 110 determines whether the detected data signal is AM or FM by determining whether the received RSSI signal has large maximum peak values with relatively low peak-to-peak variation values. If the RSSI maximum peak value is high and the peak-to-peak variation level is low, controller 110 sets an FM flag in step 343 identifying the received signal as an FM signal. If the FM flag has not been set, the received signal is assumed to be an AM signal. Next, controller 110 determines in step 335 whether it has scanned through all the bands of frequencies identified in the frequency table and then checks in step 345, whether the data flag has been set. If the data flag had been set, controller 110 advances to step 347 in which controller 110 executes a routine to more precisely identify the carrier frequency of the received RF signal A.

Figure 7C:
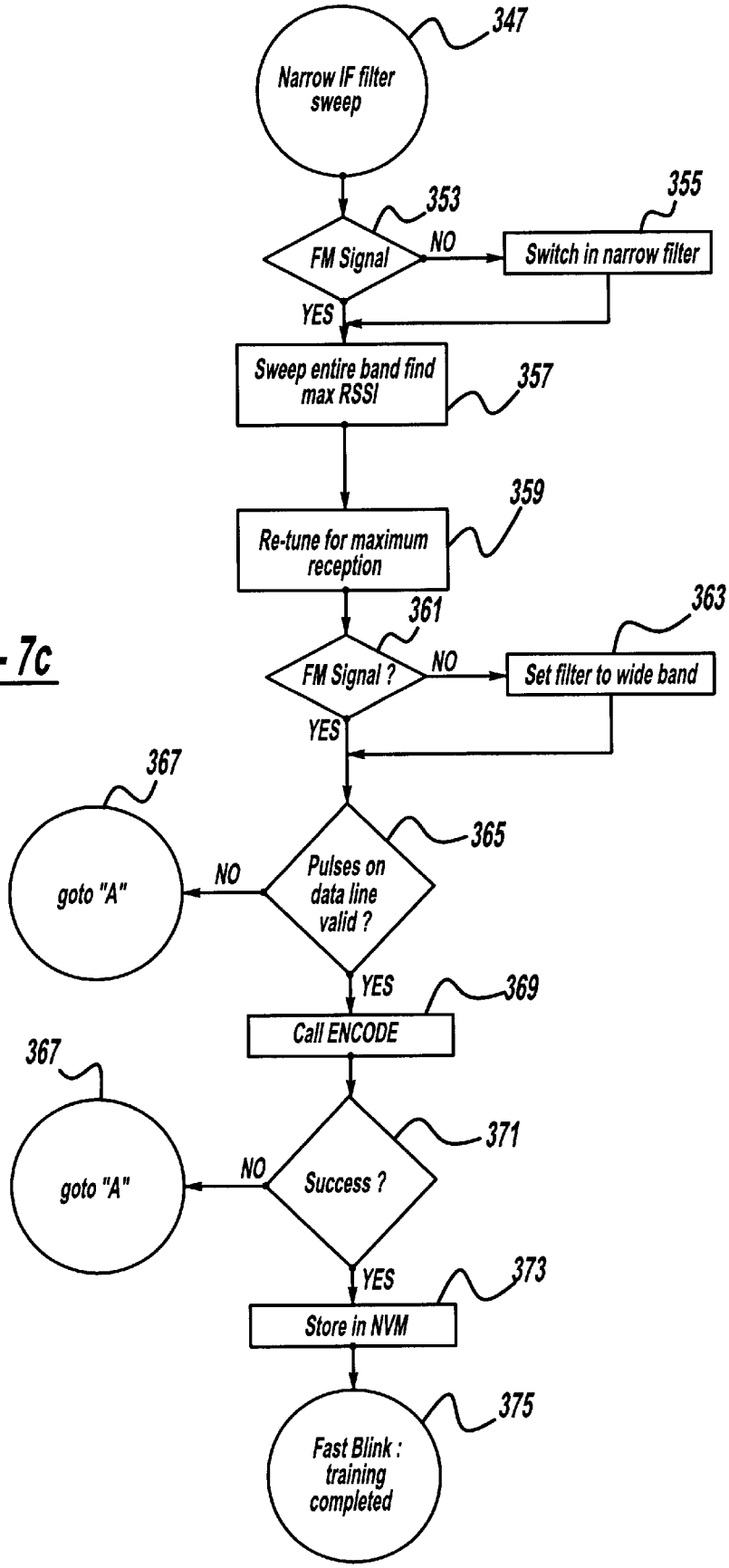

As shown in FIG. 7C, controller 110 begins this next routine by first checking whether the FM flag has been set indicating that the received signal is an FM signal (step 353). If the signal is not an FM signal, controller 110 transmits a signal on line 149 to filter bypass switch 148 causing switch 148 to connect narrow-band bandpass filter 150 in series with wide-band bandpass filter 144 and amplifiers 146 and 152. Once the state of switch 148 has been changed in step 355 or when controller 110 determines in step 353 that an FM signal is present, controller 110 determines which frequency band is most likely to produce the signal by choosing that band that was selected when the maximum RSSI peaks were detected. Then, controller 110 sweeps the entire selected band at much smaller incremental steps of frequency to identify the precise frequency at which the maximum peak values for the received RSSI signal (step 357) were detected. Preferably, for AM signals and FM signals in the higher frequency band, controller 110 increments the frequency of the reference signal 5 kHz at a time, whereas if the signal is an FM signal in the lower frequency band, controller 110 increments the reference carrier frequency at 1.25 kHz steps.

Once the entire band has been swept in step 357, controller 110 retunes signal generator 159 to the reference carrier frequency that produced the maximum peak levels of RSSI data as sensed at the input connected to line 153. Controller 110 then resets bypass switch 148 to bypass narrow-band bandpass filter 150 in step 363 provided the received signal is an AM signal as determined in step 361.

With the reference frequency set at a value that produces an RSSI input signal having the maximum peak levels, controller 110 analyzes the data output from AM and FM data slicers 154 and 158 to determine whether a received data signal corresponds to a valid signal (step 365). This verification routine is preferably carried out by performing the steps of the VERIFY routine disclosed in U.S. Pat. No. 5,661,804. If controller 110 determines in step 365 that the received data signal is not valid, controller 110 returns to step 337 (FIG. 7B) as indicated by connector 367, to select a different frequency from the frequency table in order to determine whether data is present at a different carrier frequency.

If controller 110 determines in step 365 that the received data signal is valid, controller 110 executes an ENCODE routine in step 369 in order to encode the received data signal for efficient storage in RAM 116 and NVM 118. Controller 110 selects the data signal received from FM data slicer 158 if it has determined that the received signal is an FM signal, and encodes the signal received from the AM data slicer 154 if the received signal is an AM signal. Preferably, controller 110 performs the ENCODE routine disclosed in U.S. Provisional Application No. 60/065,517 entitled METHOD AND APPARATUS FOR STORING A DATA ENCODED SIGNAL, filed on Nov. 12, 1997, by Kurt A. Dykema, in order to accommodate certain RF signals having long periods of dead time between data code words that are often transmitted by garage door opening transmitters commonly used in Europe. The entire disclosure of U.S. Provisional Application No. 60/065,517 is incorporated by reference herein.

If controller 110 determines that the encoding of the data signal was successful (step 371), controller 110 stores the encoded signal in NVM 118 (step 373) and transmits a signal to user interface 120 to cause user interface 120 to indicate to the user that training has been successfully completed. In the event that an LED 48 is utilized in user interface 120, controller 110 transmits a signal thereto causing LED 48 to rapidly blink (step 375). If, in step 371, controller 110 determines that the data signal was not successfully encoded, controller 110 returns to step 337 (FIG. 7B) as illustrated by connectors 367.

In addition to storing the encoded data signal in NVM 118, controller 110 also stores in association therewith, the frequency data last used to control signal generator 159. Such data includes the frequency control data output on line 165 as well as the frequency band select data output on line 203. Additionally, controller 110 stores a flag in association with the frequency data indicating whether the signal was identified as an AM or FM signal. As will be explained below, this stored information may be subsequently utilized to transmit a modulated signal having characteristics corresponding to those learned during the training mode for that particular channel. In a similar manner, trainable transmitter circuit 100 may be used to learn and store the signal characteristics of additional signals. Such additional signal characteristics would be stored in different locations of NVM 118 assigned to each different channel.

Figure 7D:
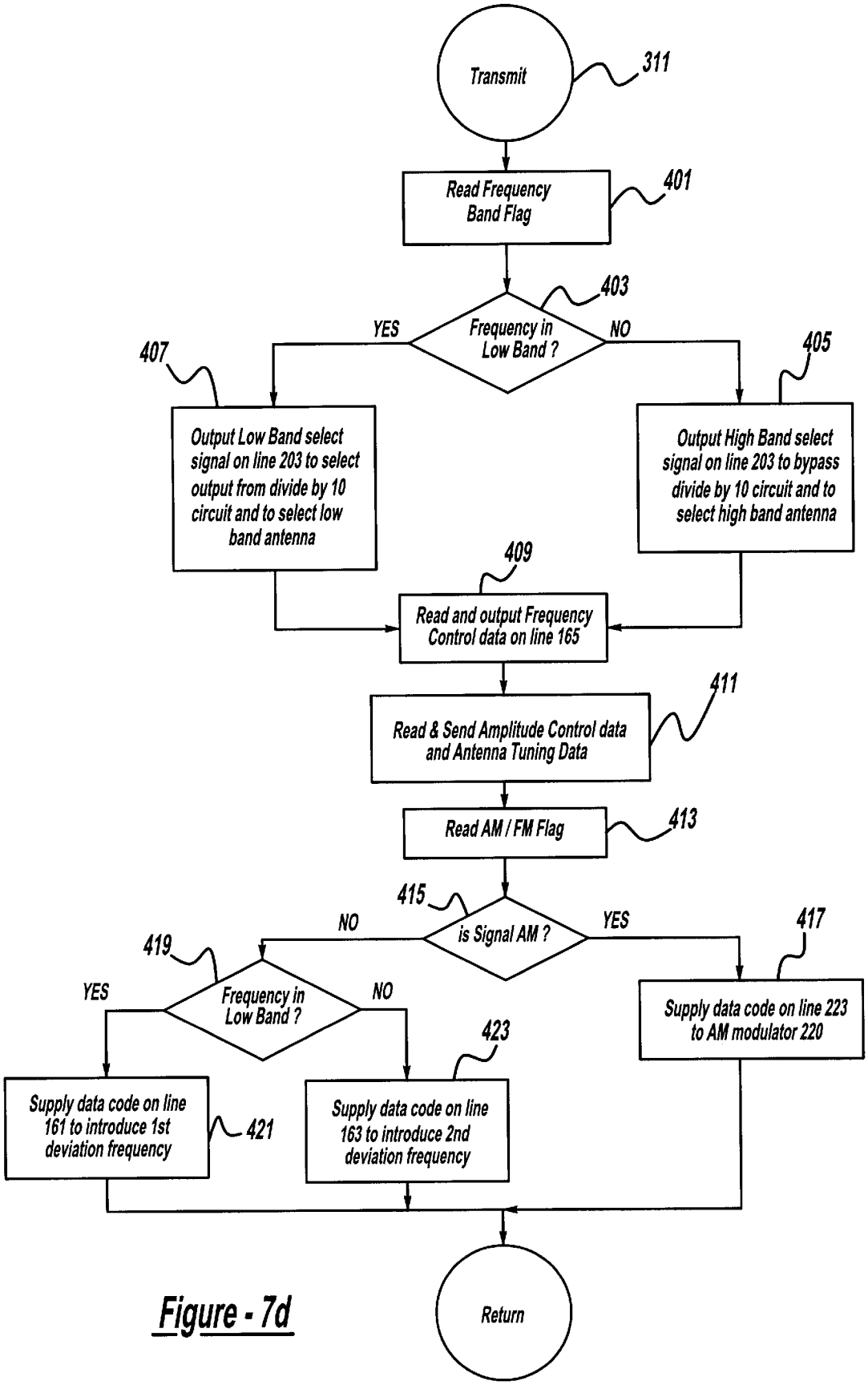

Having described the routine for training the trainable transmitter to learn the characteristics of a received RF signal A, the routine performed to cause the trainable transmitter to transmit a signal having the learned characteristics is described below with reference to FIG. 7D. As shown in FIG. 7D, in the transmit mode, controller 110 first reads the frequency band select data stored in NVM 118 in association with the channel corresponding to the activated switch (step 401). If, in step 403, controller 110 determines that the carrier frequency of the signal to be generated is not in the lower frequency band, controller 110 outputs a high frequency band select signal on line 203 to bypass divide by 10 circuit 204 and to select high-band antenna 240 through manipulation of antenna select switch 230 (step 405). On the other hand, if controller 110 determines that the carrier frequency of the signal to be generated lies in the lower frequency band, controller 110 outputs a low-frequency band select signal on line 203 to select the output from divide by 10 circuit 204 and to select low-band antenna 250 (step 407).

After selecting the appropriate antenna and configuring signal generating circuit 200 to the proper frequency band, controller 110 reads from the associated channel memory, the frequency control data representing the carrier frequency of the signal to be generated by VCO 202. Controller 110 then outputs this frequency control data on line 165 to PLL circuit 170 in frequency synthesis and control circuit 160 (step 409). In the manner described above, frequency synthesis and control circuit 160 and signal generating circuit 200 cooperate and respond to the signals supplied on lines 165 and 203 to generate a signal having a carrier frequency as specified by the frequency data supplied from controller 110.

Next, controller 110 reads and transmits the appropriate amplitude control data to amplitude control circuit 210 via line 213 in order to adjust the amplitude of the generated signal to the maximum level for a signal having the selected carrier frequency as permitted in the country in which the trainable transmitter is to be operated (step 411). Also, controller 110 outputs a frequency identification signal on line 241 to be received by antennas 240 and 250 for purposes of tuning these antennas to the optimum impedance level for transmission of a signal at the selected frequency. Subsequently, controller 110 reads the AM/FM flag for the selected channel (step 413) so that it may subsequently determine whether the signal to be transmitted is an AM or FM signal (step 415). If the signal to be transmitted is an AM signal, controller 110 reads and decodes the encoded data signal from NVM 118 and supplies the data code to amplitude modulation/filter circuit 220 via line 223 (step 417). Amplitude modulation/filter circuit 220 responds to this data by modulating the amplitude of the signal received from amplitude control circuit 210. The modulated signal is then transmitted through antenna select switch 230 to the selected antenna 240 or 250. Upon receiving the modulated signal, the selected one of antennas 240 and 250 transmits a signal B1 or B2, respectively, to remotely actuated devices 140 or 142. Two remotely actuated devices 140 and 142 are shown in FIG. 5 to illustrate the existence of different devices having receivers tuned to respond to frequencies in a lower frequency band (device 142) and frequencies in a higher frequency band (device 140).

If, in step 415, controller 110 determines that the signal to be transmitted is an FM signal, controller 110 then determines in step 419 whether the carrier frequency is in the lower frequency band or in the higher frequency band. If the carrier frequency is in the lower frequency band, controller 110 reads and decodes the encoded data signal stored in NVM 118 and supplies the data signal to switch 182 via line 161. The data signal applied to switch 182 causes it to fluctuate between conductive and nonconductive states in response to the data signal thereby deviating the reference frequency supplied to PLL circuit 170. As the reference frequency received by PLL circuit 170 deviates between frequencies, PLL circuit responds by varying the voltage level applied on line 169 to VCO 202. VCO 202 responds to the varied voltage level by varying its output frequency. Because the data signal applied to switch 182 corresponds to the data signal obtained from frequency discriminator 156 and FM data slicer 158 when the received RF signal A is applied thereto, the frequency generated by VCO 202 during the transmit mode varies in the same manner as the received FM signal. Hence, a replicated FM signal may be generated and subsequently transmitted using a selected one of antennas 240 and 250.

If controller 110 determines in step 419 that the frequency is in the higher frequency band, controller 110 supplies the data signal read from NVM 118 to switch 184 via line 163 to introduce a different deviation frequency than that introduced when the data signal is supplied to switch 182 for frequencies in the lower frequency band. Clearly, if additional deviation frequencies are required to replicate a received FM signal, additional switches and data supply lines may be provided to vary the reference frequency applied to PLL circuit 170 by differing amounts.

Although the above description does not explicitly describe how the trainable transmitter learns and transmits a code that varies from one actuation to the next in accordance with a cryptographic algorithm, it will be appreciated by those skilled in the art that the teachings of U.S. Pat. No. 5,661,804 may be readily incorporated within the device disclosed herein to enable it to learn and subsequently transmit such variable codes. Specifically, during the training mode, controller 110 would analyze the identified carrier frequency and data code of the received RF signal A once they have been identified to determine whether they correspond to characteristics of signals typically transmitted from commercially-available systems that utilize a cryptographic algorithm to vary the transmitted codes. Based on such an identification, controller 110 may then select one of a plurality of cryptographic algorithms that may be stored in NVM 118, for use in generating the variable data code to be subsequently transmitted by the trainable transmitter. More specifically, with the identification of a particular cryptographic algorithm stored in memory and with an identification of the last transmitted code, controller 110 may determine the next code to be transmitted in accordance with that cryptographic algorithm upon actuation of an associated switch. The generated variable code is then supplied to either amplitude modulation/filter circuit 220 or frequency synthesis and control circuit 160 for modulation of a carrier signal having the learned carrier frequency.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the Doctrine of Equivalents.

The invention claimed is:

1. A trainable transmitter for learning the characteristics of a received RF signal and for transmitting a modulated RF signal having the learned characteristics to a remote device, said trainable transmitter comprising:

a receiver for receiving an RF signal;

a controller coupled to said receiver for determining whether the received RF signal is FM or amplitude modulated, identifying the characteristics of the received RF signal including an RF carrier frequency and data code as well as an indication whether the received RF signal is frequency or amplitude modulated, and storing the identified signal characteristics; and a transmitting circuit coupled to said controller for receiving the stored signal characteristics and for generating and transmitting a modulated RF signal having the learned signal characteristics.

2. The trainable transmitter as defined in claim 1, wherein said controller determines whether the received RF signal is frequency or amplitude modulated based upon the peak amplitude and peak/peak amplitude variation of an RSSI signal derived from said received RF signal.

3. The trainable transmitter as defined in claim 1, wherein said transmitting circuit includes:

a frequency control circuit coupled to said controller for generating frequency control signals in response to frequency control data received from said controller; and a signal generating circuit coupled to said frequency control circuit for generating an RF carrier signal having a carrier frequency selected in response to the frequency control signal supplied from said frequency control circuit.

4. The trainable transmitter as defined in claim 3, wherein said signal generating circuit includes:

a VCO coupled to said frequency control circuit for generating an RF signal having a carrier frequency corresponding to a voltage level of the frequency control signal supplied thereto from said frequency control circuit, the carrier frequency falling within a first frequency band;

a frequency divider circuit coupled to said VCO for receiving the RF signal generated thereby and for outputting an RF signal having a carrier frequency that is a fraction of that of the RF signal output from said signal generator, the carrier frequency of the RF signal output from said frequency divider circuit falling within a second frequency band; and a signal selecting switch coupled to said controller for selecting the RF signal generated by either of said VCO or said frequency divider in response to a frequency band select signal received from said controller.

5. The trainable transmitter as defined in claim 3, wherein said frequency control circuit includes a frequency modulator coupled to said controller for varying the frequency control signal supplied to said signal generating circuit in response to the data code supplied by said controller, and wherein said signal generating circuit responds to the variance in the frequency control signal by deviating the frequency of the generated RF signal.

6. The trainable transmitter as defined in claim 3, wherein said transmitting circuit further includes an amplitude modulator coupled to said signal generating circuit and to said controller for selectively modulating the amplitude of the RF carrier signal generated by said signal generating circuit in accordance with the data code supplied from said controller.

7. The trainable transmitter as defined in claim 3, wherein said transmitting circuit further includes an amplitude control circuit coupled to said controller and to said signal generating circuit for adjusting the amplitude of the RF carrier signal generated by said signal generating circuit in accordance with amplitude control data supplied by said controller.

8. The trainable transmitter as defined in claim 3, wherein said transmitting circuit further includes:

a first antenna for transmitting signals having carrier frequencies within a first frequency band;

a second antenna for transmitting signals having carrier frequencies within a second frequency band; and an antenna select switch coupled between said signal generating circuit and said first and second antennas and coupled to said controller for selectively applying the generated RF signal to one of said antennas as selected by said controller, wherein said controller selects said first antenna if the carrier frequency of the generated RF signal is within the first frequency band, and selects said second antenna if the carrier frequency of the generated RF signal is within the second frequency band.

9. The trainable transmitter as defined in claim 1, wherein said receiver includes:

a reference signal generator coupled to said controller for generating a reference signal;

an antenna for receiving an RF signal from a remote transmitter; and a mixer coupled to said antenna and said reference signal generator for receiving and mixing the received RF signal and said reference signal to output a signal modulated with any data code present in the received RF signal and having a carrier frequency corresponding to a difference in carrier frequencies of the received RF signal and the reference signal.

10. The trainable transmitter as defined in claim 9, wherein said receiver further includes:

a first bandpass filter coupled to said mixer for blocking signals output from said mixer that have carrier frequencies outside a first frequency pass band;

a second bandpass filter coupled to said first bandpass filter for blocking signals output from said first bandpass filter that have carrier frequencies outside a narrower second frequency pass band; and a bypass switch coupled to said first bandpass filter and to said controller for selectively bypassing said second bandpass filter in response to a filter select signal generated by said controller.

11. The trainable transmitter as defined in claim 9, wherein said receiver further includes:

a frequency discriminator coupled to said mixer for generating a binary signal corresponding to deviations in frequency of a received FM RF signal; and an FM data slicer coupled to said frequency discriminator and said controller for digitizing the binary signal and supplying the digitized signal to said controller.

12. The trainable transmitter as defined in claim 9, wherein said receiver further includes an AM data slicer coupled to mixer and said controller for digitizing a data code contained in a received amplitude modulated signal and supplying the digitized data code to said controller.

13. A trainable transmitter for learning the characteristics of a received RF signal and for subsequently transmitting a modulated RF signal having the learned characteristics to a remote device, said trainable transmitter comprising:

a receiver for receiving an FM RF signal;

a controller coupled to said receiver for identifying and storing signal characteristics including the RF carrier frequency and code of the received FM RF signal; and a transmitting circuit coupled to said controller for receiving the stored signal characteristics and for generating and transmitting an FM RF signal having the learned signal characteristics.

14. The trainable transmitter as defined in claim 13, wherein said transmitting circuit includes:

a frequency control circuit coupled to said controller for generating frequency control signals in response to frequency control data received from said controller; and a signal generating circuit coupled to said frequency control circuit for generating an RF carrier signal having a carrier frequency selected in response to the frequency control signal supplied from said frequency control circuit.

15. The trainable transmitter as defined in claim 14, wherein said signal generating circuit includes:

a VCO coupled to said frequency control circuit for generating an RF signal having a carrier frequency corresponding to a voltage level of the frequency control signal supplied thereto from said frequency control circuit, the carrier frequency falling within a first frequency band;

a frequency divider circuit coupled to said VCO for receiving the RF signal generated thereby and for outputting an RF signal having a carrier frequency that is a fraction of that of the RF signal output from said signal generator, the carrier frequency of the RF signal output from said frequency divider circuit falling within a second frequency band; and a signal selecting switch coupled to said controller for selecting the RF signal generated by either of said VCO or said frequency divider in response to a frequency band select signal received from said controller.

16. The trainable transmitter as defined in claim 14, wherein said frequency control circuit includes a frequency modulator coupled to said controller for varying the frequency control signal supplied to said signal generating circuit in response to the data code supplied by said controller, and wherein said signal generating circuit responds to the variance in the frequency control signal by deviating the frequency of the generated RF signal.

17. The trainable transmitter as defined in claim 14, wherein said transmitting circuit further includes an amplitude control circuit coupled to said controller and to said signal generating circuit for adjusting the amplitude of the RF carrier signal generated by said signal generating circuit in accordance with amplitude control data supplied by said controller.

18. The trainable transmitter as defined in claim 13, wherein said receiver includes:

a reference signal generator coupled to said controller for generating a reference signal;

an antenna for receiving an RF signal from a remote transmitter; and a mixer coupled to said antenna and said reference signal generator for receiving and mixing the received RF signal and said reference signal to output a signal modulated with any data code present in the received RF signal and having a carrier frequency corresponding to a difference in carrier frequencies of the received RF signal and the reference signal.

19. The trainable transmitter as defined in claim 18, wherein said receiver further includes:

a frequency discriminator coupled to said mixer for generating a binary signal corresponding to deviations in frequency of a received FM RF signal; and an FM data slicer coupled to said frequency discriminator and said controller for digitizing the binary signal and supplying the digitized signal to said controller.

20. A trainable transmitter for learning and transmitting an activation signal that includes an RF carrier frequency modulated with a code, said trainable transmitter comprising:

a receiver for receiving an activation signal;

a memory having a plurality of sets of amplitude control data stored therein, each set of amplitude control data including amplitude control data representing different permissible amplitude levels for one of a plurality of different countries;

means for selecting one of said sets of amplitude control data based upon the country in which the trainable transmitter is to be operated;

a controller operable in a learning and an operating mode, said controller coupled to said receiver for generating and storing data corresponding to the RF carrier frequency and code of the received activation signal when in the learning mode, and, when in the operating mode, said controller provides output data which identifies the RF carrier frequency and code of the received activation signal and amplitude control data read from the selected set of amplitude control data stored in said memory;

a signal generator coupled to said controller for receiving output data and generating a modulated RF carrier signal representing the received activation signal; and an amplitude control circuit coupled to said signal generator and to said controller for receiving amplitude control data from said controller to selectively control the amplitude of the modulated RF carrier signal received from said signal generator at an amplitude level indicated by the received amplitude control data, and for transmitting an amplitude-controlled output signal.

21. The trainable transmitter as defined in claim 20, wherein said controller determines the amplitude level based upon signal characteristics of the received activation signal.

22. The trainable transmitter as defined in claim 21, wherein said controller determines the amplitude level based upon the detected RF carrier frequency of the received activation signal.

23. A trainable transmitter for learning the characteristics of a received RF signal and for transmitting a modulated RF signal having the learned characteristics to a remote device, said trainable transmitter comprising:

a receiver for receiving an RF signal having an RF carrier frequency within one of a first frequency band and a second frequency band, said second frequency band having lower frequencies than said first frequency band;

a controller coupled to said receiver for determining whether the RF carrier frequency of the received RF signal is within said first frequency band or said second frequency band, and for identifying and storing the characteristics of the received RF signal including the RF carrier frequency and code; and a signal generating circuit coupled to said controller for receiving the stored signal characteristics and for generating and transmitting from an output terminal thereof, a modulated RF signal having the learned signal characteristics, said signal generating circuit including:

a variable frequency oscillator for generating a carrier signal having a selected frequency within said first frequency band, and a frequency divider coupled between an output of said oscillator and said output terminal of said signal generating circuit for selectively dividing the frequency of the carrier signal generated by said oscillator to provide a carrier signal having a selected frequency within said second frequency band.

24. The trainable transmitter as defined in claim 23, wherein said signal generating circuit further includes a signal selecting switch coupled to said controller for selecting the RF signal generated by either of said VCO or said frequency divider in response to a frequency band select signal received from said controller.

25. The trainable transmitter as defined in claim 23, wherein said VCO generates an RF signal having a carrier frequency selected from within a range of 250 MHz to 450 MHz and said frequency divider outputs an RF signal having a carrier frequency selected from within a range of 25 MHz to 45 MHz.

* * * * *

UNITED STATES PATENT AND TRADEMARK OFFICE

CERTIFICATE OF CORRECTION

PATENT NO. : 6,091,343
APPLICATION NO. : 08/993420
DATED : July 18, 2000
INVENTOR(S) : Dykema et al.

It is certified that error appears in the above-identified patent and that said Letters Patent is hereby corrected as shown below:

On the Title page item "[75] Inventor: Kurt A. Dykema, Holland, Mich.; Mark D. Matlin, Boulder; Kenneth R. Zurawski, Louisville, both of Colo."

Should read: "[75] Inventor: Kurt A. Dykema, Holland, Mich.; Mark D. Matlin, Boulder; Kenneth R. Zurawski, Louisville, both of Colo. and Fred Bassali, Great Neck, NY."

Signed and Sealed this
Seventeenth Day of March, 2015

Michelle K. Lee

Michelle K. Lee
*Director of the United States Patent and Trademark Office*